United States Patent [19]

Haraga et al.

[11] Patent Number: 5,051,345

[45] Date of Patent: Sep. 24, 1991

[54] SILVER HALIDE REVERSAL PHOTOGRAPHIC LIGHT-SENSITIVE MATERIAL

[75] Inventors: Hideaki Haraga; Masaru Iwagaki; Atsuo Ezaki, all of Tokyo, Japan

[73] Assignee: Konica Corporation, Tokyo, Japan

[21] Appl. No.: 478,709

[22] Filed: Feb. 8, 1990

Related U.S. Application Data

[63] Continuation of Ser. No. 208,882, Jun. 20, 1988, abandoned.

[30] Foreign Application Priority Data

Jun. 21, 1987 [JP] Japan ..... 62-153859

[51] Int. Cl.[5] ..... G03C 7/305

[52] U.S. Cl. ..... 430/505; 430/506; 430/544; 430/362

[58] Field of Search ..... 430/505, 506, 509, 544

[56] References Cited

U.S. PATENT DOCUMENTS

| | | | |
|---|---|---|---|
| 4,388,401 | 6/1983 | Hasebe et al. | 430/505 |
| 4,608,334 | 8/1986 | Shuto et al. | 430/505 |
| 4,725,529 | 2/1988 | Shimazaki et al. | 430/505 |
| 4,729,943 | 3/1988 | Pfaff et al. | 430/362 |

FOREIGN PATENT DOCUMENTS

| | | |
|---|---|---|
| 107817 | 5/1984 | European Pat. Off. . |
| 2591355 | 6/1987 | France . |
| 2013356 | 8/1979 | United Kingdom . |

OTHER PUBLICATIONS

Patent Abstracts of Japan vol. 10, No. 169 (P-468) [2225] Jun. 14, 1986 JP-A-61-20038; 1/28/86.

Patent Abstracts of Japan vol. 10, No. 198 (P-476) [2254] Jul. 11, 1986 JP-A-61-42656; 3/1/86.

*Primary Examiner*—Charles L. Bowers, Jr.

*Assistant Examiner*—Mark R. Buscher

*Attorney, Agent, or Firm*—Jordan B. Bierman; Bierman and Muserlian

[57] ABSTRACT

A silver halide reversal photographic light-sensitive material is disclosed, which is improved in color reproducibility and gradation. The photographic material comprises a support having thereon a photographic component layers including at least two silver halide layers and a DIR layer. At least one of the emulsion layers comprises at least two silver halide emulsion layers which are substantially the same in color-sensitivity and different from each other in speed. The DIR layer contains a DIR compound and a silver halide emulsion and does not substantially contribute for any image formation.

8 Claims, No Drawings

SILVER HALIDE REVERSAL PHOTOGRAPHIC LIGHT-SENSITIVE MATERIAL

This application is a continuation of application Ser. No. 208,882, filed June 20, 1988 abandoned.

FIELD OF THE INVENTION

This invention relates to a silver halide reversal photographic light-sensitive material and, more particularly, to a color reversal light-sensitive material improved on color reproduction and gradation.

BACKGROUND OF THE INVENTION

A silver halide reversal photographic light-sensitive material has been required so far to have a variety of characteristics. It has therefore been essential that a silver halide reversal photograph is to be provided with improved color reproduction and more desirable gradation so as to meet the demands for making an image quality higher.

In the case of silver halide reversal photographic light-sensitive materials, it has practically been impossible to apply a technique of compensating the side-absorption of a coloring matter by making use of such a colored coupler as those having been applied to a color negative light-sensitive material but a development effect has mainly been utilized instead. Namely, there has utilized such an effect that the development of the silver halide in one emulsion layer inhibits those in the other layers, that is so-called an interimage effect (hereinafter abbreviated to an IIE). Because one of the most popular development-inhibiting substances is iodine ion, there have been well-known techniques for increasing IIE, in which, for example, the iodide contents of silver halide emulsions are controlled separately by each layer, or the silver iodide contents of both of the surfaces and insides of silver halide grains are adjusted. Also, Japanese Patent Examined Publication No. 35011-1984 and Japanese Patent Publication Open to Public Inspection (hereinafter referred to as Japanese Patent O.P.I. Publication) No. 91946-1987 disclose the techniques in which a fogged emulsion or an internally fogged emulsion is utilized. Further, Japanese Patent O.P.I. Publication No. 51941-1976 discloses a hydroquinone derivative capable of releasing an organic inhibitor. In the above-given techniques on the whole, an IIE control is attempted in the primary developing step, however, a satisfactory effect has not always been achieved, because the above-mentioned means has generally little effect on an attempt to increase an IIE in the primary developing step, i.e., the black-and-white development step of a color reversal process and the means has further raised the problems of various bad influences such as a faulty desalting which is apt to occur when a silver iodide content is increased and stains which is produced in the secondary development step.

On the other hand, there has been a well-known attempt that an interlayer effect is tried to be produced in a color developing step, i.e., in the secondary developing step of a reversal process. Japanese Patent O.P.I. Publication No. 84646-1986, for example, discloses a technique in which an IIE is obtained by diffusing scavengers for the oxidized products of a color developing agent from one layer into the other layers so that the color density of the layers may be regulated. This technique has many passive advantages because the primary development is not seriously affected, however, the positive effects thereof are not so noticeable. Therefore, a technique capable of increasing an IIE has so far been demanded for.

Meanwhile, gradation may be regarded as an essential factor exerting an influence upon the image quality of silver halide reversal light-sensitive materials. In silver halide reversal light-sensitive materials, such gradation may be controlled mainly by changing the characteristics of silver halide grains. Namely, an aimed gradation may be obtained by controlling the iodide contents of silver halides or by mixing plural silver halides which are different in grain size and sensitivity. However, these techniques have not been satisfactory, because not only any great effect has not been expectable in general, but also many problems have been raised, such as a faulty desalting which is apt to occur when a silver iodide content is increased and a graininess deterioration which is apt to occur when a grain size is enlarged.

There is also a well-known means in which a gradation may be adjusted by making use of two silver halide emulsion layers each different in speed. In this means, however, an IIE has been apt to further decrease, while an aimed gradation has readily been obtainable and both of color reproduction and gradation have been very hardly compatible with each other.

SUMMARY OF THE INVENTION

In order to solve the above-mentioned problems, an object of the invention is to provide a silver halide reversal light-sensitive material excellent in both color reproduction and gradation.

The above-mentioned object of the invention can be accomplished with a silver halide reversal photographic light-sensitive material comprising a support having thereon a photographic component layers including at least two silver halide layers, at least one of which comprises of at least two silver halide emulsion layers each having substantially the same color sensitivity and different in speed, and a DIR layer which does not substantially contribute for any image formation and contains a DIR compound and a silver halide emulsion.

DETAILED DESCRIPTION OF THE INVENTION

Now, the invention will be described in more detail.

At least two silver halide emulsion layers of the invention each different in speed are comprised of a plurality of silver halide emulsion layers each having substantially the same color-sensitivity and the different speed. The meaning of the expression, 'substantially the same color-sensitivity', includes that, the color-sensitivity of light-sensitive layers are regarded as substantially the same even when both of the light-sensitive regions are slightly different each other in one and the same wavelength range, that is, even when the two spectral sensitivities are slightly different each other, provided that the light-sensitive layers have a light-sensitivity to a certain spectral wavelength region such as either one of blue-, green- and red-regions of an ordinary type multilayered color light-sensitive material.

When a light-sensitive layer having the same color-sensitivity is comprised of two layers each different in speed, it is preferred that a higher speed silver halide emulsion layer and a lower speed silver halide emulsion layer should be arranged in order from the side far from a support. When it is comprised of three or more layers, it is similarly preferred that the silver halide emulsion layers should be arranged in order of those having more higher speed and from the side far from the support.

When the light-sensitive layer is comprised of two layers, the optimum speed difference between or among the higher and lower speed silver halide emulsion layers may be obtained in a commonly known method, taking a gradation and so forth into consideration. Usually, the difference thereof is preferably from 0.2 to 1.5 and, more preferably, from 0.3 to 1.0, each in terms of Δlog E, (in which E represents an exposure). Such Δlog E value may be adjusted to an optimum value in accordance with silver halide emulsion grain sizes, chemical ripening degrees and the amounts of inhibitors added. The density proportion of image formed by the higher speed silver halide emulsion layer to image formed by the lower speed silver halide emulsion layer is preferably within the range of from 10:90 to 90:10 and, more preferably, from 25:75 to 75:25.

Also, when the light-sensitive layer having the same color-sensitivity is comprised of three or more layers, an optimum value thereof may be obtained in the same way as mentioned above.

The silver halide emulsions relating to the invention are allowed to use therein silver bromide, silver iodobromide, silver chloride and silver chloroiodobromide. A preferable silver chloride content is from 0 mol % to 90 mol % and, more preferably, from 0 to 50 mol %.

The silver halide emulsions relating to the invention are allowed to contain silver iodide. A silver iodide content is preferably not more than 20 mol %, more preferably not more than 12 mol % and, particularly from 0 to 6 mol %.

It is preferred that the rest of the compositions of the silver halide emulsions relating to the invention should be silver bromide.

It is also preferred that the silver halide emulsions relating to the invention should be monodispersed. In the invention, the monodispersed silver halide emulsions contain silver halides having the grain sizes within the range of +20% with respect to the average grain size d thereof in an amount of preferably not less than 60% by weight of the amount by weight of the whole silver halide grains, more preferably not less than 70% by weight and, partucularly not less than 80% by weight. An average grain size d mentioned herein is defined as a grain size di obtained when a product ni x $di^3$ of a frequency ni of grains having a grain size di and $di^3$, in which the significant digits are three and the fractions of 5 and over are counted as a unit and the rest is disregarded.

The term, 'grain size', mentioned herein means a grain diameter when silver halide grains are spherical-shaped, or a diameter of a circular image having the same area as that of the projective image of the grain when silver halide grains are other than spherical-shaped.

Grain sizes ma be measured in such a manner that they are photographed after they are magnified ten thousand to fifty thousand times by an electron microscope and the diameters of the grains or the projective areas thereof are measured on the printed photograph, (provided that the numbers of the grains to be measured are indiscriminately not less than one thousand.)

When a grain size distribution (%) is defined by the following formula.

$$\frac{\text{Standard deviation}}{\text{Average grain size}} \times 100 = \text{Grain size distribution (\%)},$$

the grain size distribution of the particularly preferable highly monodispersed emulsions of the invention should be not more than 20%, provided herein that an average grain size and a standard deviation are to be obtained from the above-defined di.

Such monodispersed emulsions may be obtained in such a manner that a water-soluble silver salt solution and a water-soluble halide solution are added into a gelatin solution containing seed grains, under the control of pAg and pH, in a double-jet process. The particularly preferable preparing processes may be referred to Japanese Patent O.P.I. Publication No. 46640-1984.

An average grain size d of the silver halide emulsions of the invention should be within the range of, preferably, from 0.05 to 10.0 μm and, more preferably, from 0.1 to 5.0 μm.

In the silver halide emulsions of the invention, the silver halide grains thereof are allowed to have either the uniform distribution of a halide composition, or the different halide compositions between the inside and outside of grains i.e., the so-called core/shell type grains.

The silver halide emulsions of the invention are also allowed to have such a regular crystal form as a cube, octahedron, tetradecahedron and so forth. In these grains, any ratio of a (100) plane to a (111) plane may be applied and it is further allowed to mix any other grains having a variety of crystal forms therein.

The silver halide emulsions applicable to the invention may also be the mixtures of two or more kinds of silver halide emulsions each separately prepared.

Silver halide grains applicable to the silver halide emulsions of the invention may be added therein with metal ions by making use of at least one kind of metal salts selected from the group consisting of the salts of cadmium, zinc, lead, thallium, iridium including the complex salts thereof, rhodium including the complex salts thereof and iron including the complex salts thereof so that these metal elements may be contained in the inside and/or surfaces of the grains. It is also allowed to provide reduction-sensitization nuclei to the inside and/or surfaces of the grains, when the grains are put in an atmosphere suitable for reduction.

The silver halide emulsions of the invention may be chemically sensitized in an ordinary process. Namely, a sulfur sensitization, a selenium sensitization, a reduction-sensitization, a noble metal sensitization using gold or other noble metal compounds and so forth may be used independently or in combination.

The silver halide emulsions of the invention may also be optically sensitized to a desired wavelength region by making use of a dye which is known as a sensitizing dye in the photographic industry. These sensitizing dyes may be used independently or in combination. The silver halide emulsions of the invention are also allowed to contain, together with the sensitizing dyes, a supersensitizer capable of enhancing the sensitization function of the sensitizing dyes, that is, a dye having no spectral sensitizing function in itself or a compound incapable of substantially absorbing any visual rays of light.

Now, a DIR compounds which may be contained in the DIR layers of the invention will be described. Such a DIR compound may also be added into any ordinary type of silver halide emulsion layers at the same time when the DIR compounds are added into the DIR layers.

In the invention, the DIR compounds mean a compound capable of releasing either a development inhibitor or a compound capable of releasing the development inhibitor, upon reaction with the oxidized product of a color developing agent. Among these DIR compounds, a diffusible DIR compounds should be preferred.

In the invention, the diffusible DIR compounds mean a compound capable of releasing either a development inhibitor upon reaction with the oxidized product of a color developing agent or a compound capable of releasing another compound capable of releasing a development inhibitor thereupon and the diffusibility of the above development inhibited or compound capable of releasing a development inhibitor should be not less than 0.34 and, more preferably, not less than 0.40 in accordance with the evaluation method of which will be described later.

The diffusibility may be evaluated in the following method.

Samples (I) and (II) each of light-sensitive materials are prepared so as to comprise a transparent support bearing thereon the layers having the following composition.

Sample (I): A sample having a green-sensitive silver halide emulsion layer

This sample was prepared in the following manner.

A gelatin coating solution was so prepared as to contain silver iodobromide spectrally sensitized to green (having a silver iodide content of 6 mol % and an average grain size of 0.48 μm) and the following coupler in an amount of 0.07 mols per mol of silver, and the resulted gelatin coating solution was coated so that an amount of silver coated may be 1.1 g/m$^2$ and an amount of gelatin added may be 3.0 g/m$^2$. Further, to serve as a protective layer coated thereon, another gelatin coating solution containing silver iodobromide neither chemically nor spectrally sensitized (having a silver iodide content of 2 mol % and an average grain size of 0.08 μm) was coated so that an amount of silver coated may be 0.1 g/m$^2$ and an amount of gelatin added may be 0.8 g/m$^2$.

Coupler

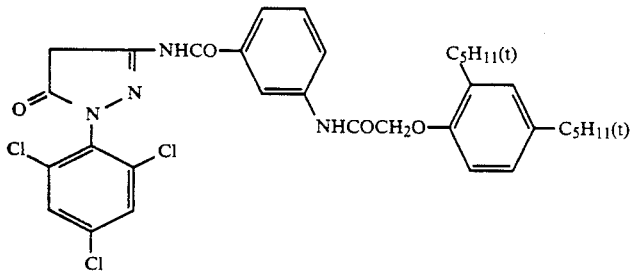

Sample (II): Sample prepared by eliminating silver iodobromide from the protective layer of the above-mentioned Sample (I)

To each of the layers, a gelatin hardener and a surface active agent were added, besides the above-given materials.

The samples (I) and (II) were exposed to white light through a an optical wedge and were then treated in the following processing steps. As for the developers, there used one added with various development inhibitors in an amount capable of inhibiting the light-sensitivity of Sample (II) to 60% (that is, $-\Delta\log E=0.22$ in logarithmic terms) and the other not added with any development inhibitor.

| Processing steps (at 38° C.) | |
|---|---|
| Color developing | 2 min. 40 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The composition of the processing solutions used in the above-mentioned processing steps were as follows.

| | |
|---|---|
| [Color developer] | |
| 4-amino-3-methyl-N-ethyl-N-(β-hydroxyethyl)aniline sulfate | 4.75 g |
| Sodium sulfite, anhydrous | 4.25 g |
| Hydroxylamine ½ sulfate | 2.0 g |
| Potassium carbonate, anhydrous | 37.5 g |
| Potassium bromide | 1.3 g |
| trisodium nitrilotriacetate monohydrate | 2.5 g |
| Potassium hydroxide | 1.0 g |
| Add water to make | 1 liter |
| [Bleaching solution] | |
| Ferric-ammonium ethylenediamine-tetraacetate | 100.0 g |
| Diammonium ethylenediaminetetraacetate | 10.0 g |
| Ammonium bromide | 150.0 g |
| Glacial acetic acid | 10.0 ml |
| Add water to make | 1 liter |
| Adjust pH with aqueous ammonia to | pH = 6.0 |
| [Fixer] | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to | pH = 6.0 |
| [Stabilizer] | |
| Formalin (a 37% aqueous solution) | 1.5 ml |
| Koniducks (Manufactured by Konishiroku Photo Ind. Co., Ltd.) | 7.5 ml |
| Add water to make | 1 liter |

Desensitization degree of Sample (I) is represented by the following formula:

$$\Delta S=S_0-S_I,$$

Desensitization degree of Sample (II) is represented by the following formula:

$$\Delta S_0=S_0-S_{II}, \text{ and}$$

$$Diffusibility = \Delta S/\Delta S_0,$$

wherein $S_0$ represents a sensitivity of Sample (I) obtained when no development inhibitor was added; $S_0$, represents a sensitivity of Sample (II); S represents a sensitivity of Sample (I) obtained when a development inhibitor was added; and $S_{II}$ represents a sensitivity of Sample (II); provided that every sensitivity are indicated by the logarithm (−log E) of the reciprocal of an exposure obtained at the point of a fog density + a density of 0.3.

According to the above mentioned method, the diffusibility of several kinds of development inhibitors were obtained. The results thereof are shown in the table given below.

TABLE

| Structure | Amt. added (Mol/liter) | Desensitization $\Delta S_0$ | Desensitization $\Delta S$ | Diffusibility $\Delta S/\Delta S_0$ |
|---|---|---|---|---|
| 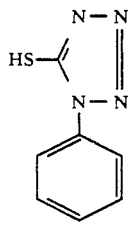 | $1.3 \times 10^{-5}$ | 0.22 | 0.05 | 0.23 |
| 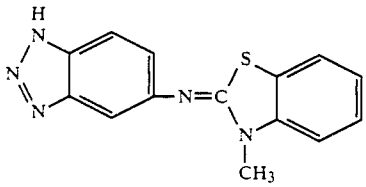 | $1.3 \times 10^{-5}$ | 0.23 | 0.08 | 0.34 |
| 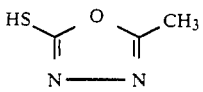 | $2.5 \times 10^{-5}$ | 0.22 | 0.10 | 0.45 |
| 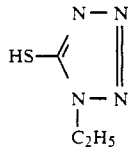 | $3.0 \times 10^{-5}$ | 0.21 | 0.10 | 0.48 |
| 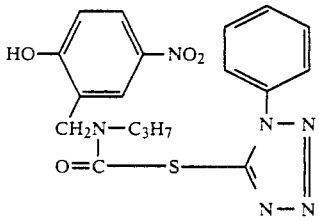 | $1.4 \times 10^{-5}$ | 0.23 | 0.11 | 0.48 |
| 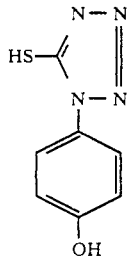 | $2.5 \times 10^{-5}$ | 0.22 | 0.13 | 0.59 |
| 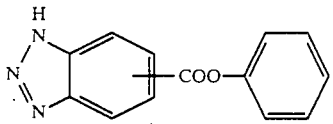 | $3.5 \times 10^{-5}$ | 0.23 | 0.15 | 0.65 |

TABLE-continued

| Structure | Amt. added (Mol/liter) | Desensitization $\Delta S_0$ | Desensitization $\Delta S$ | Diffusibility $\Delta S/\Delta S_0$ |
|---|---|---|---|---|
| 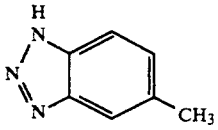 | $4.3 \times 10^{-5}$ | 0.22 | 0.16 | 0.73 |
| 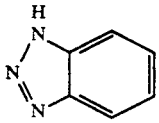 | $1.7 \times 10^{-5}$ | 0.21 | 0.20 | 0.95 |

In the DIR compounds of the invention, the diffusibility of the groups released therefrom should preferably be within the above-given range, however, any one other than the above may also be used.

Typical formulas thereof will be given below.

Formula (D-1)

A–(Y)m wherein A represent a coupler residue and Y is a development inhibiting group or a group capable of releasing a development inhibiting group, in which said group represented by Y is bonded in the coupling position of the coupler residue represented by A and capable of being split off from said coupler residue upon reaction of with the oxidized product of a color developing agent, and m represent an integer of 1 or 2.

In the above-given Formula (D-1), Y may typically be presented by the following Formulas (D-2) through (D-9).

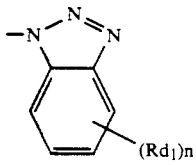

(D-2)

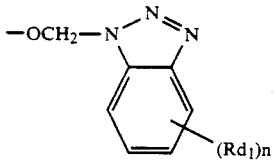

(D-3)

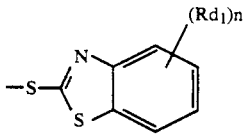

(D-4)

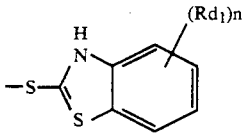

(D-5)

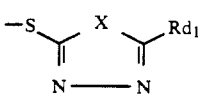

(D-6)

-continued

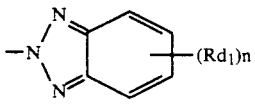

(D-7)

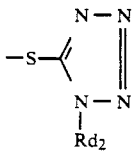

(D-8)

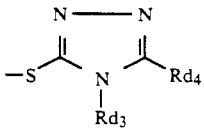

(D-9)

In the above-given formulas (D-2) through (D-7), $Rd_1$ represents a hydrogen atom, a halogen atom, or a group of alkyl, alkoxy, acylamino, alkoxycarbonyl, thiazolidinylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino, respectively; n is an integer of 0, 1or 2, provided that, when n is 2, each of $Rd_1$s may be the same with or different from each other; and a total number of carbon atoms contained in n of $Rd_1$s is from 0 to 10; and, in Formula (D-6). the number of the carbon atoms contained in $Rd_1$ is preferably from 0 to 15.

In the above-given Formula (D-6), X represents an oxygen atom or a sulfur atom.

In the above-given Formula (D-8), $Rd_2$ represents an alkyl group, an aryl group or a heterocyclic group.

In the above-given Formula (D-9), $Rd_3$ represents a hydrogen atom or a group of alkyl, cycloalkyl, aryl or heterocyclic, respectively: and $Rd_4$ represents a hydrogen atom, a halogen atom or a group of alkyl, cycloalkyl, aryl, acylamino, alkoxycarbonylamino, aryloxycarbonylamino, alkanesulfonamido, cyano, heterocyclic, alkylthio or amino, respectively.

When $Rd_1$, $Rd_2$, $Rd_3$ or $Rd_4$ represents an alkyl group, such alkyl groups include those each having a substituent and they may be straight-chained or branched.

When $Rd_1$, $Rd_2$, $Rd_3$ or $Rd_4$ represents an aryl group, such aryl groups include those each having a substituent.

When $Rd_1$, $Rd_2$, $Rd_3$ or $Rd_4$ represents a heterocyclic group, such heterocyclic groups include those each having a substituent and the preferable hetero atoms thereof should include those each having a 5- or 6-member single or condensed ring containing at least one atom selected from the group consisting of nitrogen atom, oxygen atom and sulfur atom. For example, these hetero atoms may be selected from each group of pyridyl, quinolyl, furyl, benzothiazolyl, oxazolyl, imidazolyl, thiazolyl, triazolyl, benzotriazolyl, imido, oxazine and so forth.

In the above-given Formulas (D-6) and (D-8), the number of carbon atoms contained in $Rd_2$ is from 0 to 15.

In the above-given Formula (D-9), a total number of carbon atoms contained in $Rd_3$ and $Rd_4$ is preferably from 0 to 15.

Formula (D-10)

-TIME-INHIBIT wherein TIME represents a group capable of being cleft upon reation with the oxidized product of a color developing agent and releasing an INHIBIT group with a suitable control after it is cleft from a coupler; and INHIBIT represents a group capable of serving as a development inhibitor through the above-mentioned releasing, such as the groups represented by the above-given Formulas (D-2) through (D-9).

In the above-given Formula (D-10), the -TIME-INHIBIT-group may typically be represented by the following Formulas (D-11) through (D-19).

(D-11)

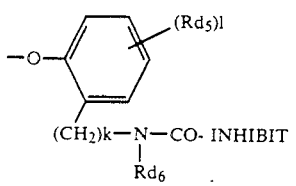

(D-12)

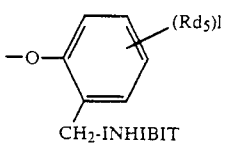

(D-13)

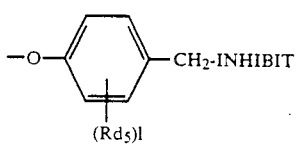

(D-14)

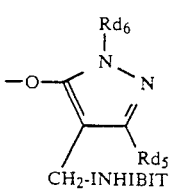

(D-15)

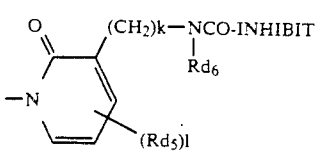

-continued (D-16)

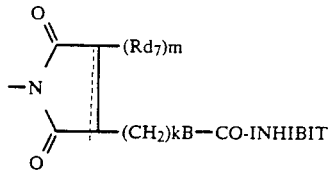

(D-17)

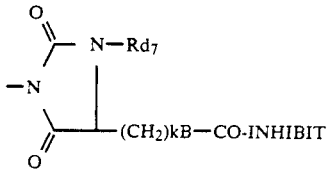

(D-18)

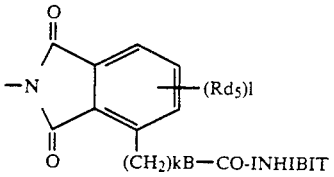

(D-19)

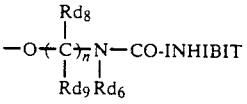

In the above-given Formulas (D-11) through (D-15) and (D-18), $Rd_5$ represents a hydrogen atom, a halogen atom or a group of alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxy, sulfo, hydroxy or alkanesulfonyl, respectively. In the Formulas (D-11) through (D-13). (D-15) and (D-18), $Rd_5$s may be coupled to each other so as to complete a condensed ring. In the Formulas (D-11), (D-14), (D-15) and (D-19), $Rd_6$ represents a group of alkyl, alkenyl, aralkyl, cycloalkyl, heterocyclic or aryl, respectively. In the Formulas (D-16) and (D-17), $Rd_7$ represents a hydrogen atom or a group of alkyl, alkenyl, aralkyl, cycloalkyl, heterocyclic or aryl, respectively. In the above-given Formula (D-19), $Rd_8$ and $Rd_9$ each represent a hydrogen atom or an alkyl group including preferably those having 1 to 4 carbon atoms. In the Formulas (D-11) through (D-13), (D-15), and (D-18), k is an integer of 0, 1 or 2. In the Formulas (D-11) through (D-13), (D-15) and (D-18), is an integer of 1 to 4. In the Formula (D-16), m is an integer of 1 or 2, provided that, when m is 2, each of $Rd_7$s may be the same with or different from each other. In the Formula (D-19), n is an integer of 2 to 4, provided that n of $Rd_8$ and $Rd_9$ may be the same with or different from each other. In the Formulas (D-16) through (D-18), B represents an oxygen atom or

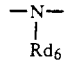

(in which $Rd_6$ is synonymous with the afore-defined. In the above-given Formula (D-16), ═══ represents that a bonding may be either a single bond or a double bond, provided that m is 2 in the case of a single bond and m is 1 in the case of a double bond, and an INHIBIT group is synonymous with those defined in the Formulas (D-2) through (D-9), except the number of carbon atoms is different.

In the INHIBIT groups, the total number of carbon atoms contained in $Rd_1$ in a molecule in the Formulas (D-2) through (D-7) is 0 to 32; the toal number of carbon atoms contained in $Rd_2$ in a molecule in the Formula (D-8) is 1 to 32: and the total number of carbon atoms contained in $Rd_3$ and $Rd_4$ in the Formula (D-9) is 0 to 32.

Among the DIR compounds, the preferable ones are those having Y represented by Formula (D-2), (D-3) or (D-10). Among those represented by Formula (D-10), the preferable ones are those having an INHIBIT group represented by Formula (D-2) or (D-6) and more preferably (D-6) in which X represents an oxygen atom, or (D-8) and more preferably the $Rd_2$ represents a hydroxyaryl group or an alkyl group having 1 to 3 carbon atoms.

In Formula (D-1), the coupler components represented by A include, for example, a yellow dye image forming coupler residual group, a magenta dye image forming coupler residual group, a cyan dye image forming coupler residual group and a non-dye forming coupler residual group.

The diffusible DIR compounds which should preferably be used in the invention include, for example, the following compounds. It is however to be understood that the invention shall not be limited thereto.

Exemplified compounds

D-1

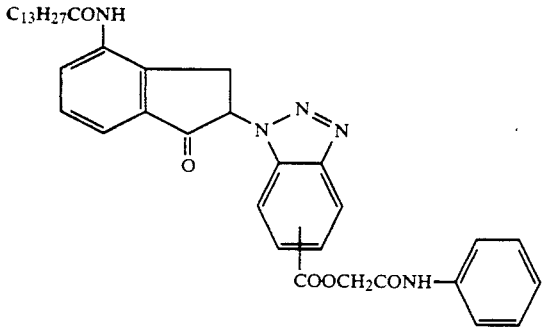

D-36

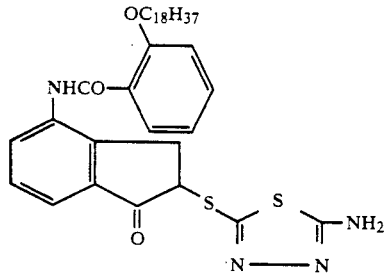

-continued

D-37

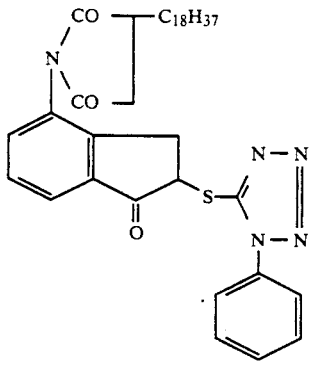

| Exemplified compound No. | $R_1$ | $R_2$ | Y |
|---|---|---|---|
| | $R_1$—COCHCO—$R_2$ (Y) | | |
| D-2 | (1) | (1) | (30) |
| D-3 | (2) | (3) | (30) |
| D-4 | (2) | (4) | (30) |
| D-5 | (5) | (6) | (31) |
| D-6 | (2) | (4) | (32) |
| D-7 | (2) | (3) | (32) |
| D-8 | (7) | (8) | (33) |
| D-33 | (2) | (4) | (55) |
| | 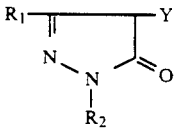 | | |
| D-9 | (9) | (10) | (30) |
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |
| D-35 | (56) | (24) | (23) |
| | 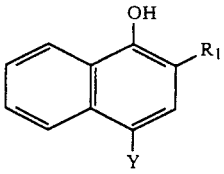 | | |
| D-15 | (17) | | (38) |
| D-16 | (17) | | (39) |
| D-17 | (18) | | (40) |
| D-18 | (19) | | (41) |
| D-19 | (18) | | (42) |
| D-20 | (18) | | (43) |
| D-21 | (18) | | (44) |
| D-22 | (18) | | (45) |
| D-23 | (18) | | (46) |
| D-24 | (20) | | (47) |
| D-25 | (20) | | (48) |
| D-26 | (21) | | (49) |
| D-27 | (21) | | (50) |
| D-28 | (21) | | (51) |
| D-29 | (22) | | (52) |
| D-30 | (18) | | (53) |
| D-31 | (18) | | (54) |
| D-32 | (22) | | (49) |
| D-34 | (18) | | (56) |

1
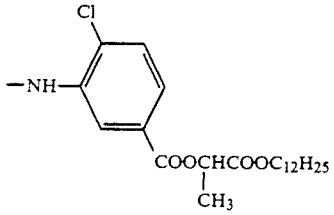
2 $-C(CH_3)_3$
3
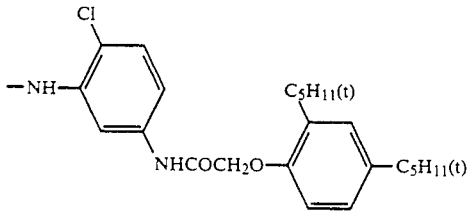
4
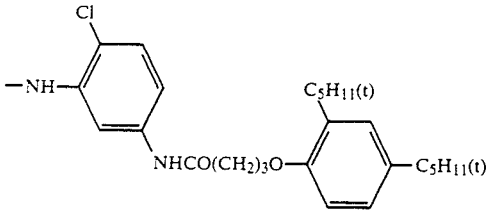
5 $-OCH_3$
6
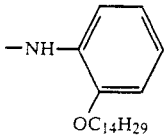
7
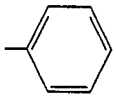
8
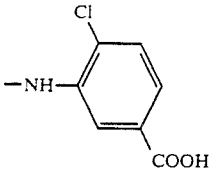
9
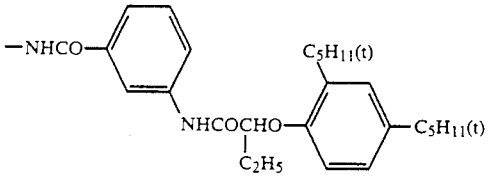
10
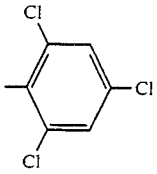
-continued
11
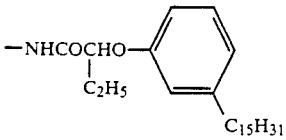
12 $-C_{17}H_{35}$
13
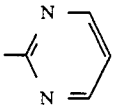
14
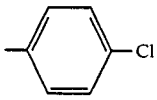
15 $-CH_3$
16
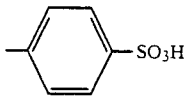
17 $-CONHC_{18}H_{37}$
18
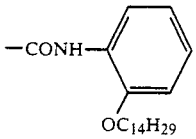
19
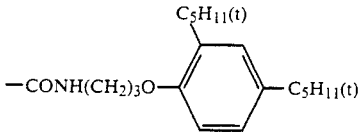
20
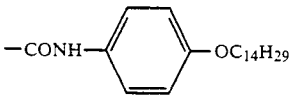
21 $-CONHCH_2CH_2COOH$
22 $-CONHCH_2CH_2COOCH_3$
23
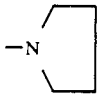
24
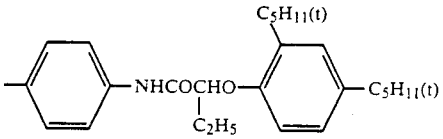
30
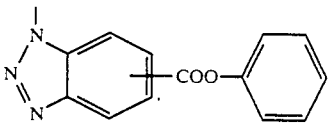

-continued
31
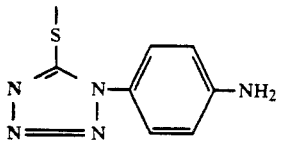
32
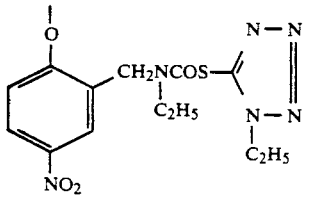
33
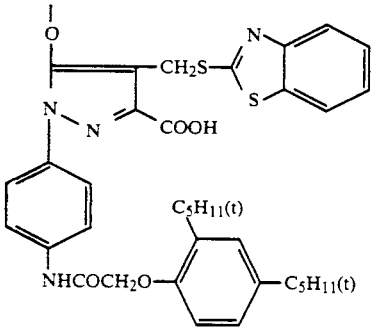
34
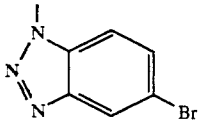
35
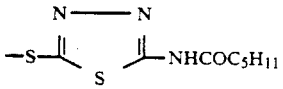
36
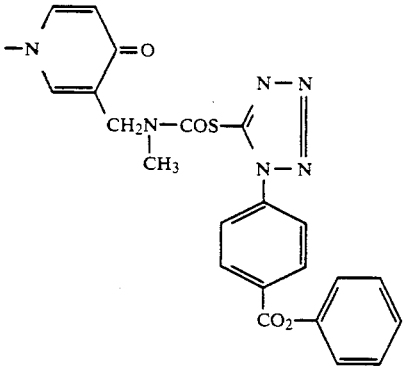
37
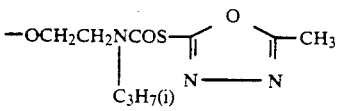
38
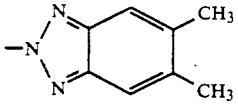
-continued
39
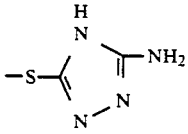
40
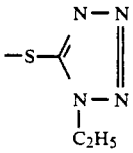
41
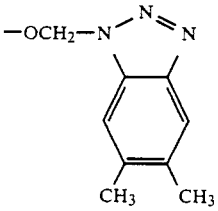
42
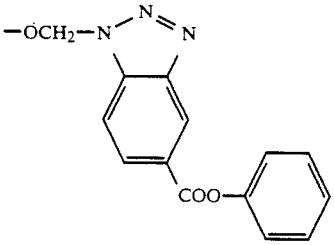
43
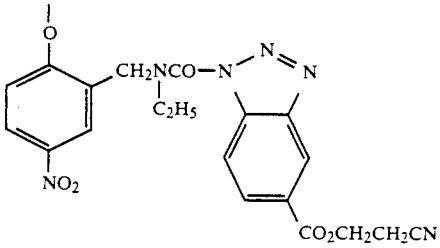
44
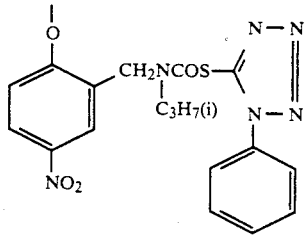
45
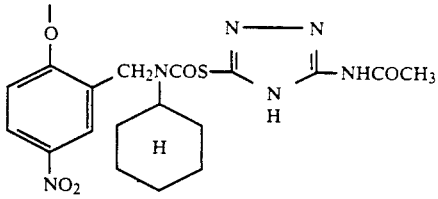

-continued

46

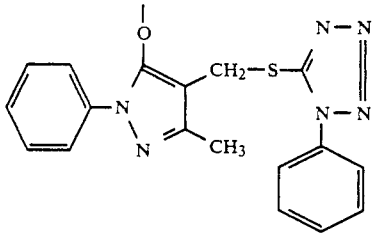

47

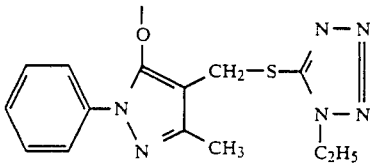

48

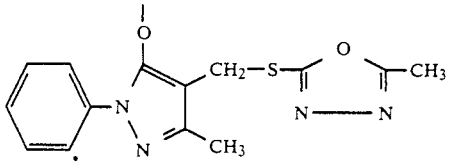

49

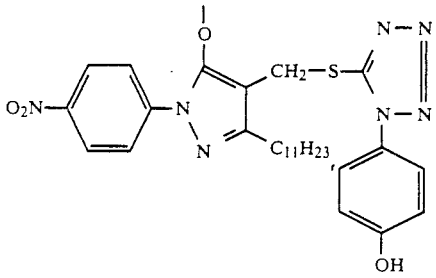

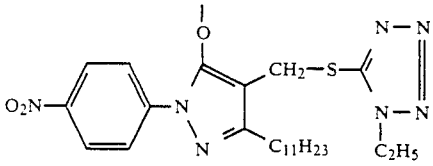

51

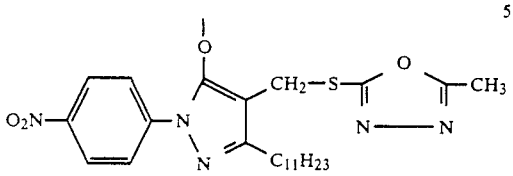

52

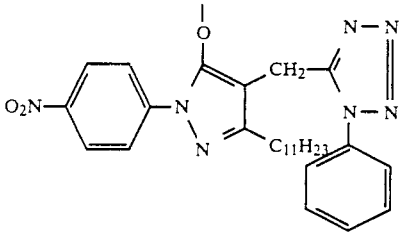

-continued

53

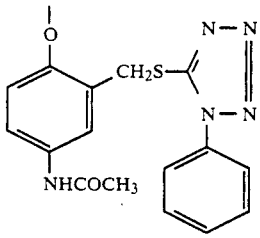

54

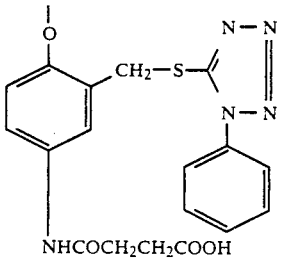

55

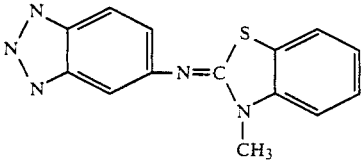

56

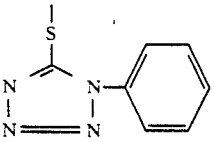

The typical examples of the DIR compounds including the above-given exemplified compounds each applicable to the invention are described in U.S. Pat. Nos. 4,234,678, 3,227,554, 3,617,291, 3,958,993, 4,149,886 and 3,933,500: Japanese Patent O.P.I. Publication Nos. 56837-1982 and 13239-1976; U.S. Pat. Nos. 2,072,363and 2,070,266; Research Disclosure No. 21,228, December, 1981; and so forth.

In the invention, the term, an 'DIR layer', means a layer containing a DIR compound and a light-sensitive silver halide emulsion, which does not form any substantial color image. The expression, a DIR layer does 'not form any substantial color image', means that the layer has a maximum density of not more than 0.3 after developed, preferably not more than 0.2 and more preferably not more than 0.1 in terms of either a transmission density in the case of a transmission type photographic material or a reflection density in the case of a reflection type photographic material. Any light-sensitive silver halides may be used in the DIR layers, such as silver chloride, silver bromide, silver iodide, silver chlorobromide, silver iodobromide, or silver chloroiodobromide. The grain size thereof may be from 0.05 to 2 μm and should preferably be from 0.1 to 1.5 μm. The amount of such silver halides coated may be from 0.01 $g/m^2$ to 3.0 $g/m^2$ and should preferably be from 0.05 $g/m^2$ to 1.5 $g/m^2$.

In the invention, there is no special limitation to the positions of the DIR layers. It is, however, preferred to arrange them to the neighborhood of a silver halide emulsion layer comprising at least two layers each having substantially the same color sensitivities which are different from the color sensitivity of the silver halides of the DIR layers. To be more concrete, for example, that may be the case that, in the case of trying to improve a red color reproducibility, a green- or blue-sensitive DIR layer, or a DIR layer containing both of a green-sensitive silver halide and a blue-sensitive silver halide should preferably be arranged to the neighborhood of a red-sensitive silver halide emulsion layer comprising at least two layers. Also, in the case of improving a green- or blue-reproducibility, the same arrangements may be applied. The word, 'neighborhood', means that a DIR layer is so arranged as to be adjacent to a silver halide emulsion layer or adjacent thereto with the interposition of an interlayer. It should be preferred to arrange the DIR layer closer to the side of a support than the above-mentioned silver halide emulsion layer comprising at leat two layers. The most preferable position of the DIR layer should be a position where it is arranged much closer to the support side than the position of the above-mentioned silver halide emulsion layer comprising at least two layers. It is also allowed to arrange one or more DIR layers on the support, and in the case of using two or more DIR layers, the color sensitivity thereof should preferably be different from each other.

The silver halide emulsions of the invention are allowed to contain an antifogging agent, a stabilizer and so forth. As for the binders for such emulsions, gelatin may advantageously be used.

Such emulsion layers and other hydrophilic collidal layers may be hardened and may also contain a plasticizer and a water-soluble or silver-dissolvable synthetic polymer dispersion that is so-called a latex.

In the emulsion layers of the color light-sensitive material, a coupler is used and, in addition, it is also allowed to use a competing coupler capable of displaying a color correction effect and a compound capable of releasing such a photographically useful fragment as a development accelerator, a developing agent, a fogging agent, an antifogging agent, a chemical sensitizer, a spectral sensitizer and a desensitizer, through a coupling to the oxidized product of a color developing agent.

To a light-sensitive material, it is allowed to apply such a auxiliary layer as a filter layer, an antihalation layer, an antiirradiation layer and so forth. These layers and/or emulsion layers are also allowed to contain a dyestuff which may be made effluent from the light-sensitive material or bleached, in the course of a development.

Such light-sensitive materials may also be added with a matting agent, a lubricant, an image stabilizer, a formalin scavenger, a UV absorbing agent, a fluorescent brightening agent, a surface active agent, a development accelerator and a development inhibitor.

As for the supports of the light-sensitive materials, a sheet of paer laminated with polyethylene or the like, a polyethyleneterephthalate film, a baryta paper, a cellulose triacetate film and so forth may be used.

When using the light-sensitive materials of the invention, a dye image may be obtained by exposing them to light and then carrying out a popularly known color reversal process.

Namely, a dye image may be obtained on the light-sensitive material in such a manner that a silver halide which was exposed to light in the primary developins step is treated in a monochromatic developing step and unexposed silver halides are then fogged in either a light-fogging treatment or a fogging bath and, successively, a color development is carried out.

EXAMPLES

Some examples of the invention will now be described below. It is, however, to be understood that the invention shall not be limited thereto.

EXAMPLE 1

Color reversal light-sensitive material No. 1 was prepared in such a manner that the following Layer 1 through Layer 12 were coated over to a paper support laminated on the both side thereof with polyethylene. The amount of each component coated will be shown in terms of g/m$^2$, provided that the amount of each silver halide will be shown in terms of an amount of silver used.

| | |
|---|---|
| Layer 1 (An antihalation layer) | |
| Black colloidal silver | 0.05 |
| Gelatin | 0.20 |
| Layer 2 (A green-sensitive DIR layer) | |
| Green-sensitive silver bromide emulsion (An average grain size: 0.7 μm) 0.10 | |
| DIR compound (D-23) | 0.10 |
| Gelatin | 2.0 |
| Layer 3 (The first interlayer) | |
| Gelatin | 0.08 |
| Color mixing inhibitor | 1.0 |
| Layer 4 (A red-sensitive layer) | |
| Cyan coupler A | 0.34 |
| Cyan coupler B | 0.17 |
| Red-sensitive silver iodobromide emulsion (A silver iodobromide content: 2 mol %) (An average grain size: 0.6 μm) | 0.20 |
| Gelatin | 2.0 |
| Layer 5 (The second interlayer) | |
| Color mixing inhibitor | 0.08 |
| Gelatin | 1.0 |
| Layer 6 (A red-sensitive DIR layer) | |
| Red-sensitive silver bromide emulsion (An average grain size: 0.6 μm | 0.1 |
| Gelatin | 2.0 |
| DIR compound (D-23) | 0.1 |
| Layer 7 (The third interlayer) | |
| Color mixing inhibitor | 0.08 |
| Gelatin | 1.0 |
| Layer 8 (A green-sensitive layer) | |
| Magenta coupler | 0.28 |
| Green-sensitive silver iodobromide emulsion (A silver iodide content: 2 mol %) (An average grain size: 0.5 μm) | 0.10 |
| Green-sensitive silver iodobromide emulsion (A silver iodide content: 2 mol %) (An average grain size: 0.9 μm) | 0.20 |
| Gelatin | 2.0 |
| Layer 9 (The fourth interlayer) | |
| Yellow colloidal layer | 0.15 |
| Color mixing inhibitor | 0.08 |
| Gelatin | 1.0 |
| Layer 10 (A blue-sensitive layer) | |
| Yellow coupler | 0.60 |
| Blue-sensitive silver iodobromide emulsion (A silver iodobromide content: 2 mol %) (An average grain size: 0.5 μm) | 0.15 |
| Blue-sensitive silver iodobromide emulsion (A silver iodobromide content: 2 mol %) (An average grain size: 1.0 μm) | 0.20 |
| Gelatin | 2.0 |
| Layer 11 (A UV absorbing layer) | |
| UV absorbing agent | |
| A | 0.2 |
| B | 0.2 |
| C | 0.2 |
| D | 0.2 |
| Gelatin | 2.0 |

-continued
| Layer 12 (A protective layer) | |
|---|---|
| Gelatin | 1.0 |
Besides the above, the color reversal light-sensitive material contained a high boiling solvent, an antifading agent, a surface active agent, a hardener and an antiirradiation dye.
Cyan coupler A
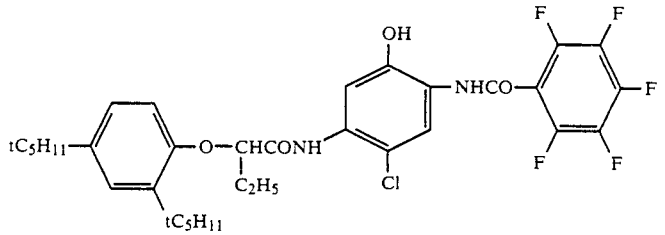
Cyan coupler B
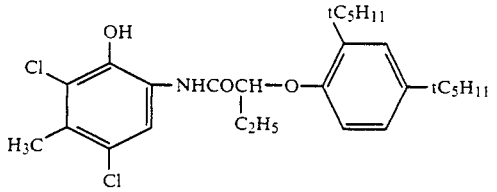
Magenta coupler
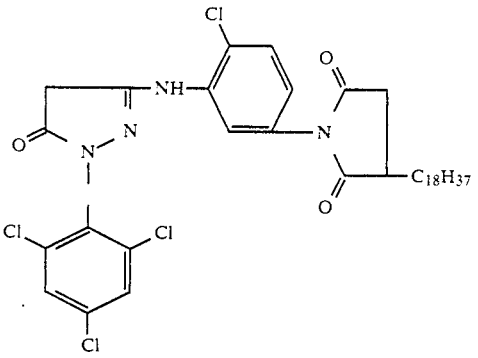
Yellow coupler
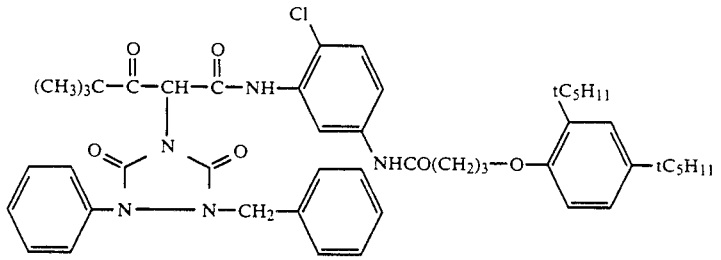
UV absorbing agent
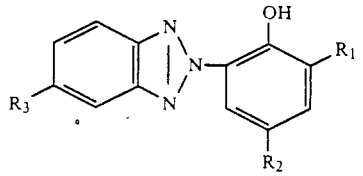
| | $R_1$ | $R_2$ | $R_3$ |
|---|---|---|---|
| A | (t)$C_4H_9$ | (t)$C_4H_9$ | H |
| B | (t)$C_4H_9$ | $CH_3$ | Cl |
| C | (t)$C_4H_9$ | (t)$C_4H_9$ | Cl |

-continued

| | | | |
|---|---|---|---|
| D | (t)$C_5H_{11}$ | (t)$C_5H_{11}$ | H |

Color mixing inhibitor

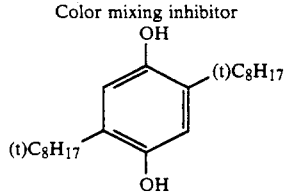

Next, Samples 2 through 4 were prepared by changing a part of the layers of Sample 1 as shown in Table 1.

TABLE 1

| Sample No. | Point of change | Remarks |
|---|---|---|
| Sample 2 | In place of the 4th layer of Sample 1, Layers 4a and the following Layer 4b were arranged in order from the support side. | Invention |
| Sample 3 | DIR compound and silver halides of both 2nd and 6th layers of Sample 2 were eliminated. | Out of the invention |
| Sample 4 | DIR compound (D-23) of 0.02 mol/mol Ag was added to Layers 4a, 4b and 8 of Sample 3, respectively. | Out of the invention |
| Layer 4a: | The first red-sensitive layer | |
| | Cyan coupler A | 0.14 |
| | Cyan coupler B | 0.07 |
| | Red-sensitive silver iodobromide emulsion | |
| | (A silver iodide content: 2 mol %) (An average grain size: 0.4 μm) | 0.14 |
| | Gelatin | 1.0 |
| Layer 4b: | The second red-sensitive layer | |
| | Cyan coupler A | 0.20 |
| | Cyan coupler B | 0.10 |
| | Red-sensitive silver iodobromide emulsion | |
| | (A silver iodide content: 2 mol %) (An average grain size: 0.6 μm) | 0.16 |
| | Gelatin | 1.0 |

The above-mentioned light-sensitive materials 1 through 4 were exposed to white light (Exposure B) and red light (Exposure A, through a CC-90R filter manufactured by Eastman Kodak Co.) and were then processed in the following order.

| | |
|---|---|
| (Processing steps) | |
| Primary developing | 1 min. 15 sec. |
| (Monochromatic developing) | (at 38° C.) |
| Washing | 1 min. 30 sec. |
| Light fogging | |
| Secondary developing | 2 min. 15 sec. |
| (Color developing) | (at 38° C.) |
| Washing | 45 sec. |
| Bleach-fixing | 2 min. (at 38° C.) |
| Washing | 2 min. 15 sec. |
| (Primary developer) | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium hydrogencarbonate | 12 g |
| 1-phenyl-4-methyl-4-hydroxymethyl-3-pyrazolidone | 1.5 g |
| Hydroquinone monosulfonate | 23.3 g |
| Add water to make | 1.0 liter (pH = 9.65) |
| (Color developer) | |
| Benzyl alcohol | 14.6 ml |

-continued

| | |
|---|---|
| Ethylene glycol | 12.6 ml |
| Potassium carbonate, anhydrous | 26 g |
| Potassium hydroxide | 1.4 g |
| Sodium sulfite | 1.6 g |
| 3,6-dithiaoctane-1,8-diol | 0.24 g |
| Hydroxylamine sulfate | 2.6 g |
| 4-N-ethyl-N-β-(methanesulfonamidethyl)-2-methyl-p-phenylenediaminesesqui-sulfate | 5.0 g |
| Add water to make | 1.0 liter |
| (Bleach-fixer) | |
| A solution containing 1.56 mol of ammonium salt of ferric ethylene-diaminetetraacetate complex | 115 ml |
| Sodium metabisulfite | 15.4 g |
| Ammonium thiosulfate (58%) | 126 ml |
| 1,2,4-triazole-3-thiol | 0.4 g |
| Add water to make | 1.0 liter (pH = 6.5) |

The red light reflection density of each processed sample was measured, and the results thereof are shown in Table 2 below.

TABLE 2

| Sample No. | Red-light reflection density*1 Exposure A | Exposure B | Latitude*2 |
|---|---|---|---|
| 1 | 0.65 | 0.80 | 1.6 |
| 2 | 0.45 | 0.85 | 2.7 |
| 3 | 1.0 | 1.0 (Standard) | 1.9 |
| 4 | 0.75 | 0.65 | 1.3 |

*1Red-light reflection densitied were obtained when a sample was exposed to red-light, Exp. A, or white-light, Exp. B. Quantities of the exposures were the same as required to obtain a density 1.0 in Sample 3.

*2In a cyan image obtained by exposing to white light, a length of the straight-line portion thereof is expressed in terms of log E.

As is obvious from Table 2, it is found that Sample 2 of the invention was the lowest in cyan density obtained when exposing it to red-light as compared to the cyan density obtained when exposing it to white-light, so that a color reproduction having a higher purity can be obtained. It is also found that the latitude obtained when exposing to white-light was the widest. When the green-sensitive layer of Sample 1 was double-layered and the modified sample was exposed to red-light and white-light and was then evaluated, the similar results were obtained.

Also, when the DIR compounds were replaced by D-6, D-17 and D-27, the same effects were obtained, respectively.

EXAMPLE 2

In this example, the amounts of sensitizing dyes and couplers added will be expressed in an amount per mol of silver halides used, unless otherwise expressly stated.

Sample 5 of a multilayered color light-sensitive material was prepared by coating over to a subbed triacetyl cellulose film support with the layers having the following composition in order from the support side.

| | |
|---|---|
| Layer 1: An antihalation layer | |
| UV absorbing agent-1 | 0.3 g/m$^2$ |
| UV absorbing agent-2 | 0.4 g/m$^2$ |
| Black colloidal silver | 0.24 g/m$^2$ |
| Gelatin | 2.7 g/m$^2$ |
| Layer 2: An interlayer | |
| 2,5-di-t-octyl hydroquinone | 0.1 g/m$^2$ |
| Gelatin | 1.0 g/m$^2$ |
| Layer 3: A low-speed red-sensitive silver halide emulsion layer | |
| AgBrI emulsion (Emulsion-1 | 0.5 g/m$^2$ |
| (An AgI content: 2.5 mol %) | (in terms |
| (An average grain size ($\gamma$): 0.35 $\mu$m) | of silver) |
| Sensitizing dye-1 | $7.6 \times 10^{-4}$ mol |
| Coupler C-1 | 0.1 mol |
| Gelatin | 0.9 g/m$^2$ |
| Layer 4: A high-speed red-sensitive silver halide emulsion layer | |
| AgBrI emulsion (Emulsion-2) | 0.8 g/m$^2$ |
| (An AgI content: 2.5 $\mu$m) | (In terms |
| (An average grain size ($\gamma$): 0.75 $\mu$m) | of silver) |
| Sensitizing dye-1 | $3.2 \times 10^{-4}$ mol |
| Coupler C-1 | 0.2 mol |
| Gelatin | 1.75 g/m$^2$ |
| Layer 5: An interlayer | |
| 2,5-di-t-octyl hydroquinone | 0.1 g/m$^2$ |
| Gelatin | 0.9 g/m$^2$ |
| Layer 6: A low-speed green-sensitive silver halide emulsion layer | |
| Emulsion-1 (In terms of silver) | 1.0 g/m$^2$ |
| Sensitizing dye-2 | $6.6 \times 10^{-4}$ mol |
| Sensitizing dye-3 | $0.6 \times 10^{-4}$ mol |
| Coupler M-1 | 0.05 mol |
| Gelatin | 0.8 g/m$^2$ |
| Layer 7: A high-speed green-sensitive silver halide emulsion layer | |
| Emulsion-2 (In terms of silver) | 1.0 g/m$^2$ |
| Sensitizing dye-2 | $2.76 \times 10^{-4}$ mol |
| Sensitizing dye-3 | $0.23 \times 10^{-4}$ mol |

-continued

| | |
|---|---|
| Coupler M-1 | 0.15 mol |
| Gelatin | 1.5 g/m$^2$ |
| Layer 8: An interlayer | |
| The same as Layer 5 | |
| Layer 9: A yellow filter layer | |
| Yellow colloidal silver | 0.1 g/m$^2$ |
| Gelatin | 0.9 g/m$^2$ |
| 2,5-di-t-octyl hydroquinone | 0.1 g/m$^2$ |
| Layer 10: A low-speed blue-sensitive silver halide emulsion layer | |
| AgBrI emulsion (Emulsion-3) | 0.4 g/m$^2$ |
| (An AgI content: 2.5 mol %) | (In terms |
| (An average grain size ($\gamma$): 0.6 $\mu$m) | of silver) |
| Coupler Y-1 | 0.3 mol |
| Gelatin | 1.3 g/m$^2$ |
| Layer 11: A high-speed blue-sensitive silver halide emulsion layer | |
| AgBrI emulsion (Emulsion-4) | 0.8 g/m$^2$ |
| An AgI content: 2.5 mol %) | (In terms |
| An average grain size ($\gamma$): 1.0 $\mu$m) | of silver) |
| Coupler Y-1 | 0.3 mol |
| Gelatin | 2.1 g/m$^2$ |
| Layer 12: The first protective layer | |
| UV absorbing agent-1 | 0.3 g/m$^2$ |
| UV absorbing agent-2 | 0.4 g/m$^2$ |
| Gelatin | 1.2 g/m$^2$ |
| 2,5-di-t-octyl hydroquinone | 0.1 g/m$^2$ |
| Layer 13: The second protective layer | |
| Non-light-sensitive fine grained AgBrI emulsion (In terms of silver) | 0.3 g/m$^2$ |
| (An AgI content: 1 mol %) | |
| (An average grain size ($\gamma$): 0.08 $\mu$m) | |
| Surface active agent comprising polymethylmethacrylate grains | |
| (Grain size: 1.5 $\mu$m) | |
| Gelatin | 0.7 g/m$^2$ |

Besides the above-given compositions, a gelatin hardener-1 and a surface active agent-1 were also added to each layer.

Further, tricresyl phosphate was used to serve as the solvent for the couplers.

UV absorbing agent-1

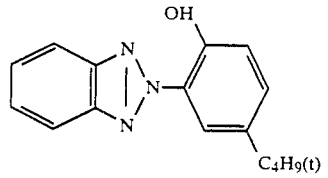

UV absorbing agent-2

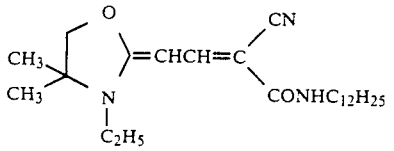

Sensitizing dye-1

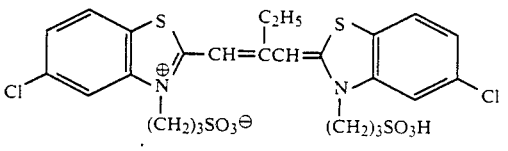

Sensitizing dye-2

-continued

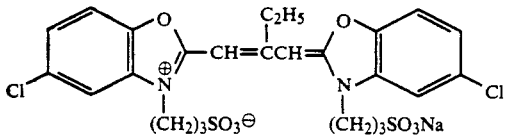

Sensitizing dye-3

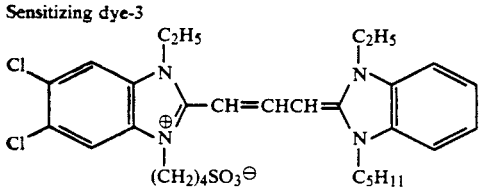

Coupler C-1

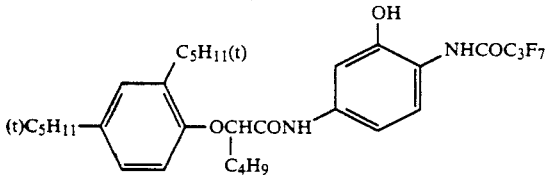

Coupler M-1

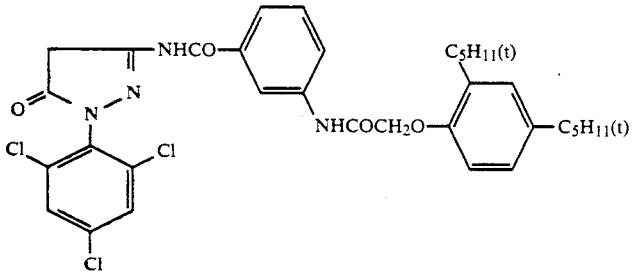

Coupler Y-1

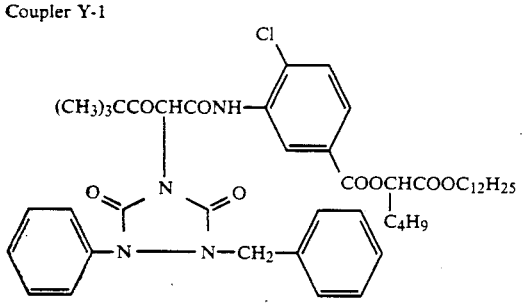

Gelatin hardener-1

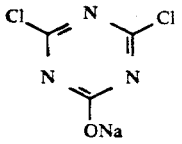

Surface active agent-1

$NaO_3S-CH(CH_2COOCH_2(CF_2CF_2)_3H)COOCH_2(CF_2CF_2)_3H$

Next, Samples 6 through 8 were prepared by changing a part of the layers of Sample 5 as shown in Table 3 below.

TABLE 3

| Sample No. | Point of change | Remarks |
|---|---|---|
| 5 | | Out of the invention |
| 6 | In Sample 5, Layers 6 and 7 were eliminated from their positions and whereto the following Layer a was arranged. | Out of the invention |
| 7 | In Sample 5, the following Layer b was interposed between | Invention |

TABLE 3-continued

| Sample No. | Point of change | Remarks |
|---|---|---|
| | Layers 1 and 2. The following layers c and d were interposed between Layers 5 and 6 in order from the side of Layer 5. | |
| 8 | In Sample 5, Layers 4 and 7 each were added with 0.04 mol of D-2, respectively. | Out of the invention |
| Layer a: | Emulsion-1 | 1.0 g/m$^2$ |
| | Emulsion-2 | 1.0 g/m$^2$ |
| | Sensitizing dye-2 | 9.36 × 10$^{-4}$ mol |
| | Sensitizing dye-3 | 0.83 × 10$^{-4}$ mol |
| | Coupler M-1 | 0.2 mol |
| | Gelatin | 2.3 g/m$^2$ |
| Layer b: | A green-sensitive DIR layer | |
| | Green-sensitive silver bromide emulsion (An average grain size: 0.7 μm) | 0.1 g/m$^2$ |
| | DIR compound (D-2) | 0.1 g/m$^2$ |
| | Gelatin | 1.5 g/m$^2$ |
| Layer c: | A red-sensitive DIR layer | |
| | Red-sensitive silver bromide emulsion (An average grain size: 0.6 μm) | 0.1 g/m$^2$ |
| | DIR compound (D-2) | 0.1 g/m$^2$ |
| | Gelatin | 1.5 g/m$^2$ |
| Layer d: | An interlayer The same as Layer 5 | |

Thus prepared Samples 5 through 8 were wedge-exposed to white-light and magenta-light through a CC-90M filter manufactured by Eastman Kodak Co. and were then processed in the following steps, respectively.

| Processing step | Time | Temperature |
|---|---|---|
| Primary developing | 6 min. | 38° C. ± 0.3° C. |
| Washing | 2 min. | 38° C. ± 0.3° C. |
| Reversing | 2 min. | 38° C. ± 0.3° C. |
| Coor developing | 6 min. | 38° C. ± 0.3° C. |
| Adjusting | 2 min. | 38° C. ± 0.3° C. |
| Bleaching | 6 min. | 38° C. ± 0.3° C. |
| Fixing | 4 min. | 38° C. ± 0.3° C. |
| Washing | 4 min. | 38° C. ± 0.3° C. |
| Stabilizing | 1 min. | ordinary temperature |
| Drying | | |

In the above processing steps, the following processing solutions were used.

| | |
|---|---|
| Primary developer | |
| Sodium tetrapolyphosphate | 2 g |
| Sodium sulfite | 20 g |
| Hydroquinone, monosulfonate | 30 g |
| Sodium carbonate, monohydrate | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (A 0.1% solution) | 2 ml |
| Add water to make | 1000 ml |
| Reversal solution | |
| sodium nitrilotrimethylenephosphonate | 3 g |
| Stannous chloride, dihydrate | 1 g |
| p-aminophenol | 0.1 g |
| Sodium hydroxide | 8 g |
| Glacial acetic acid | 15 ml |
| Add water to make | 1000 ml |
| Color developer | |
| Sodium tetrapolyphosphate | 2 g |
| Sodium sulfite | 7 g |
| Sodium tertiary phosphate, dihydrate | 36 g |
| Potassium bromide | 1 g |

-continued

| | |
|---|---|
| Potassium iodide (A 0.1% solution) | 90 ml |
| Sodium hydroxide | 3 g |
| Citrazinic acid | 1.5 g |
| N-ethyl-N-β-methanesulfonamidethyl-3-methyl-4-aminoaniline sulfate | 11 g |
| 2,2-ethylenedithiodiethanol | 1 g |
| Add water to make | 1000 ml |
| Moderating solution | |
| Sodium sulfite | 12 g |
| Sodium ethylenediaminetetraacetate, dihydrate | 8 g |
| Thioglycerol | 0.4 ml |
| Glacial acetic acid | 3 ml |
| Add water to make | 1000 ml |
| Bleaching solution | |
| Sodium ethylenediaminetetraacetate, dihydrate | 2 g |
| Ferric-ammonium ethylenediamine-tetraacetate, dihydrate | 120 g |
| Potassium bromide | 100 g |
| Add water to make | 1000 ml |
| Fixing solution | |
| Ammonium thiosulfate | 80 g |
| Sodium sulfite | 5 g |
| Sodium bisulfite | 5 g |
| Add water to make | 1000 ml |
| Stabilizer | |
| Formalin (37% by weight) | 5 ml |
| Koniducks (manufactured by Konishiroku Photo Ind. Co., Ltd.) | 5 ml |
| Add water to make | 1000 ml |

The yellow, magenta and cyan densities of each sample processed as above were measured by making use of an X-RITE densitometer in Status-A in such a manner that the yellow and cyan densities of each sample were measured when the magenta density of each sample was at 1.5. The results thereof are shown collectively in Table 4 below.

TABLE 4

| Sample | In-magenta-exposed area | | Latitude in white-exposed area | |
|---|---|---|---|---|
| No. | Yellow | Cyan | Δlog E | Linearity* |
| 5 | 0.69 | 1.20 | 2.10 | Fair |
| 6 | 0.56 | 1.12 | 1.40 | Poor |
| 7 | 0.47 | 0.46 | 2.35 | Good |
| 8 | 0.60 | 0.85 | 1.80 | Poor |

*= Δlog E: A log E value of D = 0.2 and a log E value of (Dmax − 0.2) in a magenta image
Latitude: The linearity of a characteristic curve As is obvious from Table 4, it is understood that, in Sample 7 of the invention, yellow and cyan color developments were inhibited when the sample was exposed to magenta light so as to display a highly purified color reproduction and, at the same time, a wide latitude and an excellent linearity were also obtained, as compared to the comparative samples.

According to the invention, a reversal silver halide excellent in color reproducibility and gradation can be provided.

What is claimed is:

1. A silver halide reversal photographic light-sensitive material comprising a support having thereon photographic component layers including a first silver halide emulsion layer comprising at least two silver halide emulsion sub-layers which are substantially the same in color sensitivity and different in speed from one another, said first silver halide emulsion layer being red or green sensitive, and a second silver halide emulsion layer having a color sensitivity different from that of said first silver halide emulsion layer, said second silver halide emulsion layer being a DIR layer which comprises a DIR compound and a silver halide emulsion, said DIR layer not substantially contributing to image formation, said DIR layer being adjacent, or adjacent with the interposition of an interlayer to said first silver halide emulsion layer, said DIR layer being closer to said support than said first silver halide emulsion layer.

2. The material of claim 1 wherein said first silver halide emulsion layer consists of two silver halide emulsion sub-layers and the difference in the speeds of said two sub-layers is from 0.2 to 1.5 in terms of $\Delta\log E$.

3. The material of claim 2 wherein said difference is from 0.3 to 1.0 in terms of $\Delta\log E$.

4. The material of claim 1 wherein a development inhibitor or a compound capable of releasing a development inhibitor is split off from said DIR compound upon reaction with the oxidized product of a color developing agent and has a diffusibility of not less than 0.34.

5. The material of claim 4 wherein said diffusibility is not less than 0.40.

6. The material of claim 1 wherein said DIR compound is represented by the following Formula D-1

$$A-(Y)m$$

wherein A is a coupler residue and Y is a development inhibiting group or a group capable of releasing a development inhibiting group, in which said group represented by Y is bonded in the coupling position of coupler residue and capable of being split off from said coupler residue upon reaction with the oxidized product of a color developing agent, and m is an integer of 1 or 2.

7. The material of claim 1 wherein a coating weight of said silver halide emulsion contained in said DIR layer is within the range of from 0.01 $g/m^2$ to 3.0 $g/m^2$ in terms of silver.

8. The material of claim 7 wherein said coating weight is within the range of from 0.05 $g/m^2$ to 1.5 $g/m^2$ in terms of silver.

* * * * *